US006875034B1

(12) United States Patent
Su et al.

(10) Patent No.: US 6,875,034 B1
(45) Date of Patent: Apr. 5, 2005

(54) EJECTION MECHANISM OF CARD CONNECTOR

(75) Inventors: Chia-Sheng Su, Tucheng (TW); Ming-Chun Lai, Tucheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 10/684,398

(22) Filed: Oct. 15, 2003

(51) Int. Cl.[7] ..... H01R 13/62
(52) U.S. Cl. ..... 439/159
(58) Field of Search ..... 439/152, 153, 439/155, 157, 159, 160, 923

(56) References Cited

U.S. PATENT DOCUMENTS 5,558,527 A * 9/1996 Lin ..... 439/155
6,109,941 A * 8/2000 Koseki et al. ..... 439/159
6,123,560 A * 9/2000 Hara et al. ..... 439/159
6,482,020 B1 * 11/2002 Yeh ..... 439/159
6,554,627 B1 * 4/2003 Chen ..... 439/159

* cited by examiner

*Primary Examiner*—P. Austin Bradley
*Assistant Examiner*—Felix O. Figueroa
(74) *Attorney, Agent, or Firm*—Rosenberg, Klein & Lee

(57) ABSTRACT

An ejection mechanism of card connector includes a guiding wall, a cam member, a slider, a spring and a supporting shaft. The guiding wall, the cam member and the slider engage each other. The spring acts resilience on the guiding wall. So the ejection mechanism of card connector can provides a back and forth movement in the process of loading and unloading the card. Further, the slider forms a pressed member, and the spring is located compactly between the pressed member and the guiding wall. The supporting shaft passes through the spring, one end engages one of the pressed member and the guiding wall, the other end moves back and forth relatively to the other of the pressed member and the guiding wall. In this way, the spring can be supported and positioned.

10 Claims, 5 Drawing Sheets

EJECTION MECHANISM OF CARD CONNECTOR

BACKGROUND OF THE INVENTION

1. Field of the Invention

The present invention relates generally to an ejection mechanism of card connector, and more especially to an ejection mechanism of card connector which can achieve an improved assemblage and manipulation performances for the card connector.

2. The Related Art

At present, a variety of cards, such as PCMCIA(Personal Computer Memory Card International Association) card, SD(Secure Digital) card or CF(Compact Flash) card, are used extensively following with a development of computers and peripherals. Further, the card connector, especially the one that utilizes a two-stage ejection mechanism has a correspondingly great development.

In general, the card connector with the two-stage ejection mechanism as mentioned previously includes a shield, a housing and the two-stage ejection mechanism. The two-stage ejection mechanism comprises a spring, a slider and a slider pin. The slider is provided with a heart-shaped cam groove, and the slider pin engages with the came groove to move back and forth therein. When a card is held in a room which is formed between the shield and the housing, as pushing the card for the first operation, the card can be loaded in the room by means of the movement of the slider pin and a locking structure of the cam groove. Further pushing the card for the second operation, the card can be unloaded from the room by means of the movement of the slider pin and an elasticity of the spring.

However, the card connector mentioned previously is shaped to have a receiving space in the shield or the housing for receiving the spring without any specific support members for supporting the spring. So that the spring is easy to become deformed in the assembled and operated conditions. With this result, the card connector assembles difficultly, the spring is easy to twist at the radial direction to lose efficacy, further a reliable operation of loading or unloading cards can't be achieved. In addition, although a projection or a hole for inserting or receiving an end of the spring can be arranged in the card connector, the spring can't be supported in the radial direction, so the drawbacks of the prior art still can't be solved by the conventional design.

SUMMARY OF THE INVENTION

Thus, an object of the present invention is to provide an ejection mechanism of card connector which can solve the problem that the spring twists in the radial direction to lose efficacy in the assembling and operating conditions, and can provide an improved assemblage performance and a reliable operation for the card connector.

To attain the above object, the present invention provides an ejection mechanism of card connector, which comprises a guiding wall, a slider, a cam member, a spring and a supporting shaft. The guiding wall is formed on one lateral side of a bottom board of the card connector. The slider, which can slip through the guiding wall, defines a pressed member and a mating portion. The mating portion engages with a card. The cam member includes a cam groove and a slider pin. One of the cam groove and the slider pin is arranged in the bottom board, and the other is arranged in the slider. The cam groove and the slider pin engage each other, which can result a back and forth relative movement, further can drive the slider moving back and forth relatively to the card. The spring is arranged between the pressed member of the slider and the guiding wall. The supporting shaft passes through the spring, one end engages with one of the pressed member and the guiding wall, and the other end makes a movement relative to the other of the pressed member and the guiding wall.

In another embodiment of the present invention, the pressed member is opened with a sliding aperture thereon. One end of the supporting shaft engages with the guiding wall, and the other free end passes through the spring and the sliding aperture respectively. In a further embodiment of the present invention, one end of the supporting shaft engages with the pressed member. The guiding wall is formed with a slot therein for receiving the other free end of the supporting shaft, and the supporting shaft can slide back and forth in the slot.

As mentioned above, the ejection mechanism of card connector of the present invention takes an improved configuration which provides a supporting shaft to pass through the spring, further to support and position the spring between the pressed member of the slider and the guiding wall. In this way, the problem that the spring twists in the radial direction to lose efficacy is solved, and an improved assemblage performance and a reliable operation are achieved for the card connector.

BRIEF DESCRIPTION OF THE DRAWINGS

A detailed explanation of a preferred embodiment of the present invention will be given, with reference to the attached drawings, for better understanding thereof to those skilled in the art.

DETAILED DESCRIPTION OF THE PREFERRED EMBODIMENT

Figure 1:
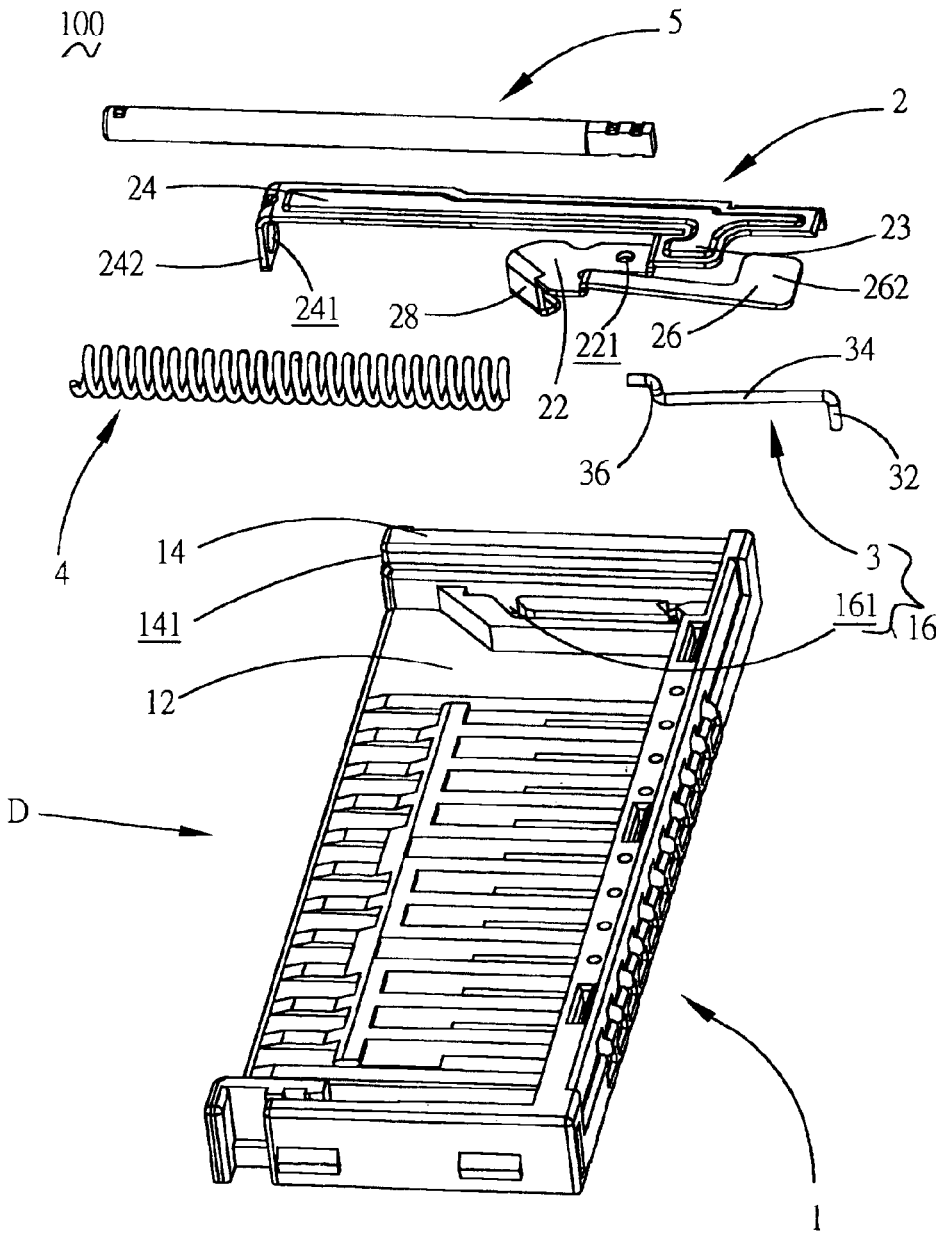
FIG. 1 is an exploded perspective view of an ejection mechanism of card connector in accordance with the present invention.

With reference to FIG. 1, an ejection mechanism of card connector, in accordance with the present invention, generally designed with reference numeral 100, comprises a frame 1, a slider 2, a slider pin 3, a spring 4 and a supporting shaft 5.

Figure 2:
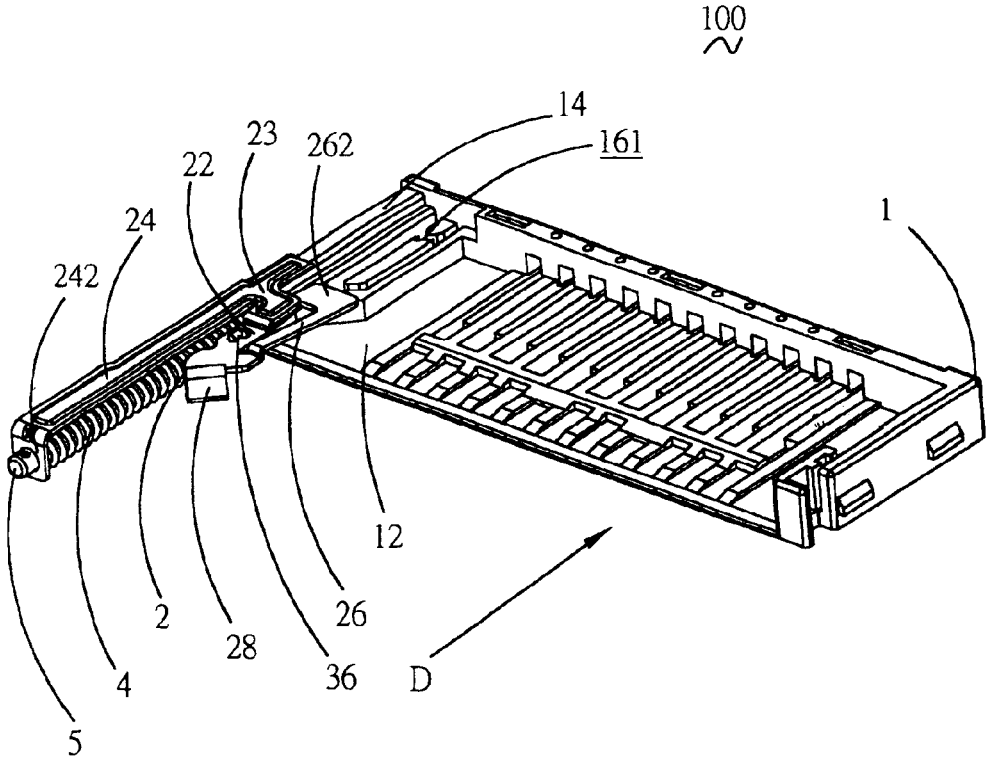
FIG. 2 is an assembled perspective view of the ejection mechanism of card connector shown in FIG. 1.

Together with reference to FIG. 2, the frame 1 includes a bottom board 12. A guiding wall 14 is formed on one lateral side of the bottom board 12, and a holding hole 141 is formed on a bottom end of the guiding wall 14. A heart-shaped cam groove 161 is arranged to adjoin the guiding wall 14 on the bottom board 12, further the cam groove 161 and the slider pin 3 constitute a cam member 16.

Figure 5:
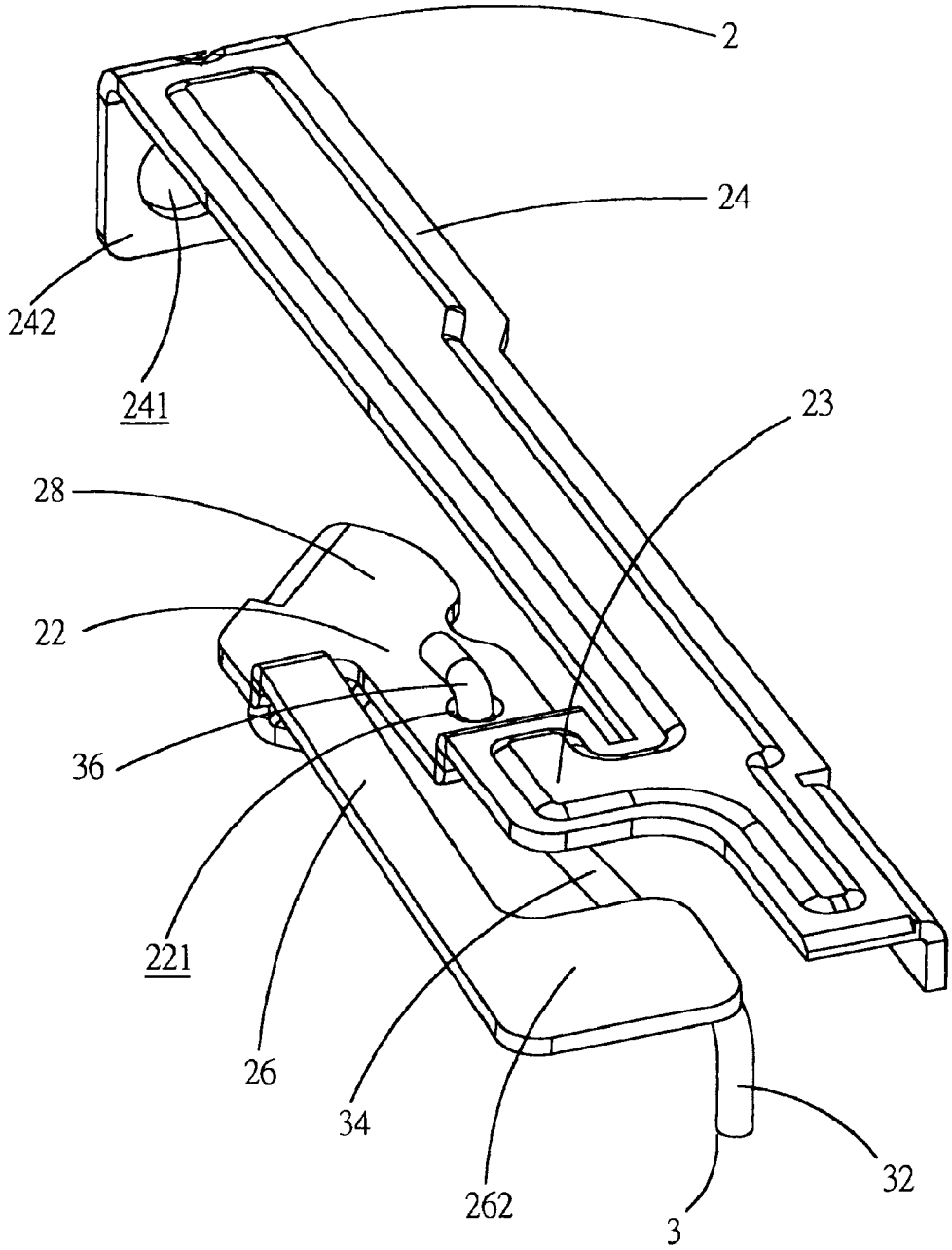
FIG. 5 is an assembled perspective view of a slider and a slider pin utilized in the ejection mechanism of card connector shown in FIG. 1.

Then, together with reference to FIG. 5, the slider 2 includes a mating portion 22, a sliding arm 24 and a bridge portion 23 for connecting the mating portion 22 and the sliding arm 24 therebetween. The slider pin 3 is composed of a following portion 32, a pivoting portion 36 and an engaging portion 34 for connecting the following portion 32 and the pivoting portion 36 therebetween.

The sliding arm 24 is shaped with a spring pressed member which contacts and presses an end of the spring 4. In this embodiment of the present invention, the pressed member is composed of a sliding blade 242 and a sliding aperture 241. The sliding blade 242 is bent downwardly and vertically from a bottom end of the sliding arm 24. The sliding aperture 241 is formed on the sliding blade 242. A diameter of the sliding aperture 241 is between an internal diameter of the spring 4 and an external diameter of the supporting shaft 5, which allows the supporting shaft 5 passing through the sliding aperture 241 and prevents the spring 4 from bouncing off the sliding aperture 241.

Figure 4:
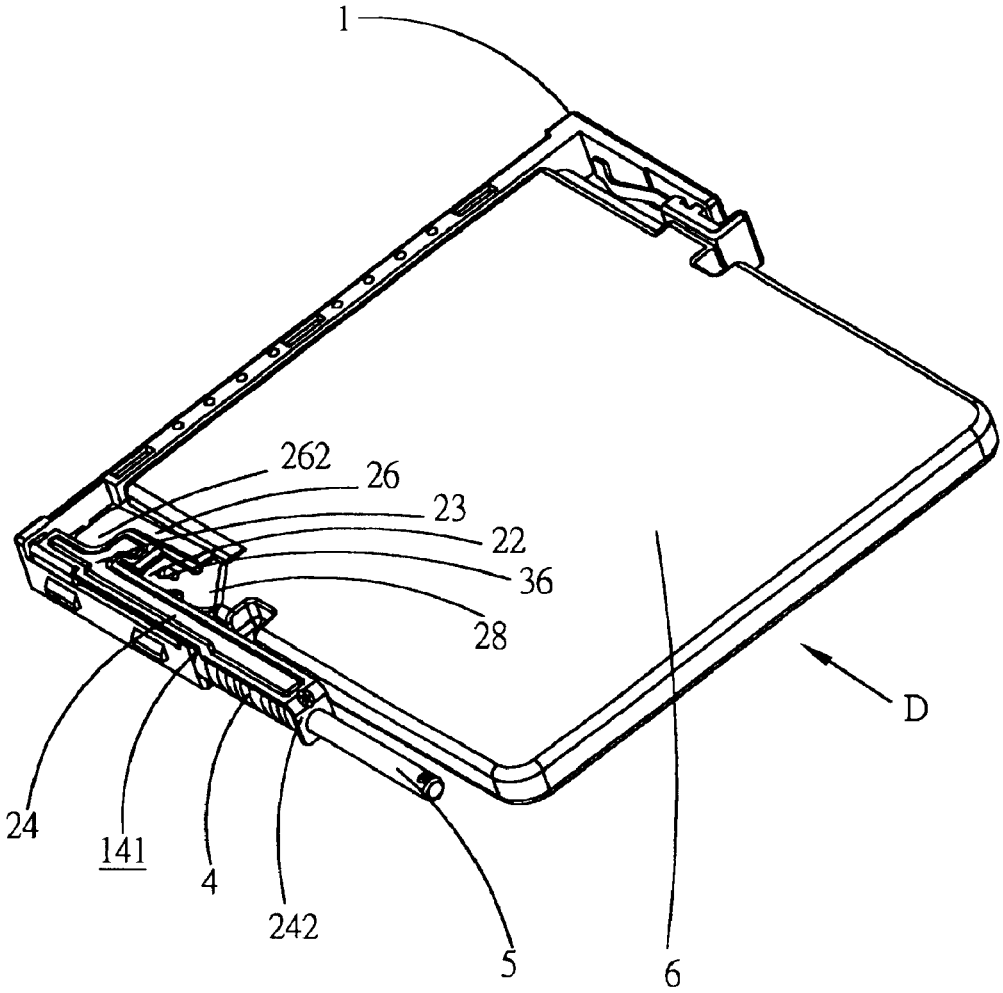
FIG. 4 is a perspective view, showing a card loading status.

The mating portion 22 of the slider 2 shown in FIG. 5 is formed in its middle part with a pivoting aperture 221 which engages with the pivoting portion 36 of the slider pin 3. A card-engaged portion 28 is defined on a bottom end of the mating portion 22 to engage with the card 6 (as shown in FIG. 4). Further, the mating portion 22 extends from its front end along the card inserting direction D to define a spring pin 26. A free front end of the spring pin 26 extends against the sliding arm 24 to form a locking portion 262 which can contact and press with the engaging portion 34 of the slider pin 3.

Referring to FIGS. 1 and 2 again, as assembling the card connector of the present invention, the pivoting portion 36 of the slider pin 3 engages pivotally with the pivoting aperture 221. The engaging portion 34 contacts and presses with the locking portion 262. The following portion 32 is located in the cam groove 161 which can move back and forth along the cam groove 161. A front end of the sliding arm 24 is hooked moveably on the guiding wall 14. The spring 4 is located between the sliding arm 24 and the guiding wall 14. The supporting shaft 5 passes through the sliding aperture 241, the spring 4 and the holding hole 141 along the card inserting direction D respectively, then, the supporting shaft 5 is held fixedly in the holding hole 141 finally.

Figure 3:
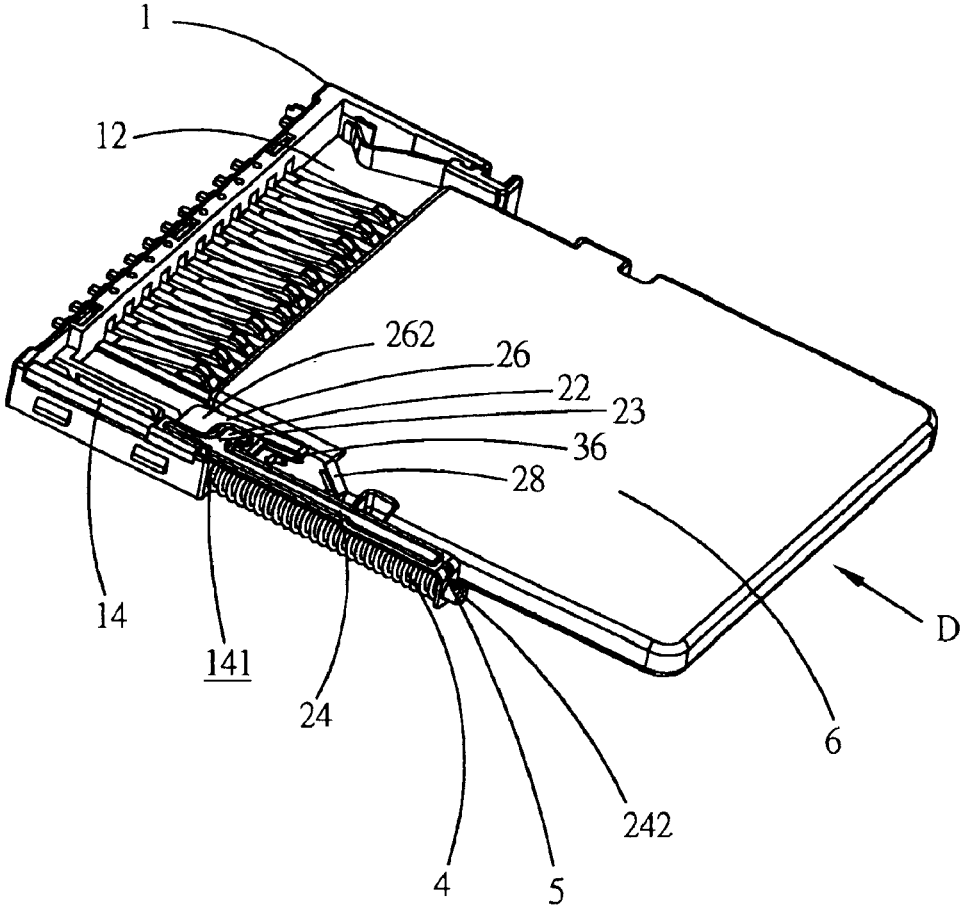
FIG. 3 is a perspective view, showing a card unloading status.

Referring now to FIGS. 3 and 4, a process of loading or unloading the card 6 is detailed below. When the card 6 is inserted in the frame 1, as shown in FIG. 3, a lateral corner of the card front end is engaged with the card-engaged portion 28 of the slider 2. As pushing the card 6 for the first operation stage, the sliding arm 24 of the slider 2 slips through the guiding wall 14, which drives the sliding blade 242 slips onward, so the spring 4 is pressed to compress axially by the sliding blade 242. Simultaneously, the following portion 32 of the slider pin 3 moves onward along the cam groove 161, and is locked in the came groove 161 by means of the conventional design. In this way, the card 6 is fixed on a position as shown in FIG. 4.

As pushing the card 6 for the second operation stage, the interlocking connection between the following portion 32 of the slider pin 3 and the cam groove 161 is removed, and the compressed spring 4 begins to elongate. Further the sliding blade 242 slips backward through the supporting shaft 5 in view of an elasticity of the spring 4, and the following portion 32 of the slider pin 3 moves backward along the cam groove 161 simultaneously. In this way, the card-engaged portion 28 of the slider 2 slides backward, so the card is withdrew from the frame 1 and placed on a position as shown in FIG. 3.

As described above, the ejection mechanism of card connector 100 of the present invention supports and positions the spring 4 between the guiding wall 14 and the sliding arm 24 by means of arranging a supporting shaft 5 to pass through the spring 4 axially. In this way, the drawbacks occurred in the prior art are avoided. The problem that the spring twists in the radial direction to lose efficacy is solved, and an improved assemblage performance and a reliable operation are achieved for the card connector.

In addition, there are many engaging manners and modifying configurations can be selected as designing the ejection mechanism of card connector 100 of the present invention. For example, the cam groove 161 of the cam member 16 can be arranged in the slider 2, while the slider pin 3 is fitted pivotally on the frame 1. Additionally, the supporting shaft 5 can fix its one end with the pressed member of the slider 2 or be shaped with the pressed member as a whole, and a long slot is formed in the guiding wall 14. In assembling condition of the latter modification design described previously, the supporting shaft 5 passes through the spring 4. The spring 4 is located between the pressed member and the guiding wall 14. A free end of the supporting shaft 5 is received in the slot and can move back and forth therein. As detailed previously, because the modifications of the ejection mechanism of card connector 100 utilize the same design principle as the above embodiment, the drawbacks of the prior art also can be solved.

Although a particular embodiment of the invention has been described in detail for purposes of illustration, additional advantages and modifications will readily appear to those skilled in the art, and various modifications and enhancements may be made without departing from the spirit and scope of the invention. Accordingly, the invention is not to be limited except as by the appended claims.

What is claimed is:

1. An ejection mechanism of a card connector comprising:

a guiding wall formed on one lateral side of a bottom board of the card connector;

a cam groove arranged to adjoin the guide wall on the bottom board;

a slider which slips through the guiding wall, the slider defining a pressed member and a mating portion, the pressed member opening a sliding aperture thereon, the mating portion engaging with a card;

a slider pin, one end of the slider pin engaging pivotally with the slider, the other end of the slider pin engaging moveably with the cam groove and moving back and forth therein;

a spring arranged between the pressed member of the slider and the guiding wall; and a supporting shaft passing through the sliding aperture and the spring further to engage with the guiding wall.

2. The ejection mechanism of a card connector as claimed in claim 1, wherein the guiding wall is formed in it a bottom end with a holding hole for holding the supporting shaft therein.

3. The ejection mechanism of a card connector as claimed in claim 1, wherein the slider has a spring pin, a free front end of the spring pin forms a locking portion which contacts and presses with the slider pin.

4. The ejection mechanism of a card connector as claimed in claim 1, wherein the slider has a sliding arm, the pressed portion is bent downwardly and vertically from a bottom end of the sliding arm.

5. An ejection mechanism of a card connector comprising:

a guiding wall formed on one lateral side of a bottom board of the card connector;

a slider which slips through the guiding wall, the slider defining a pressed member and a mating portion, the mating portion engaging with a card;

a cam member including a cam groove and a slider pin, one of the cam groove and the slider pin arranged in the bottom board, the other arranged in the slider, the cam groove and the slider pin engaging each other which results a back and forth relative movement to drive the slider moving back and forth relatively to the card;

a spring arranged between the pressed member of the slider and the guiding wall; and a supporting shaft passing through the spring, one end of the supporting shaft engaging with one of the pressed member and the guiding wall.

6. The ejection mechanism of a card connector as claimed in claim 5, wherein the slider has a spring pin, a free front end of the spring pin forms a locking portion which contacts and presses with the slider pin.

7. The ejection mechanism of a card connector as claimed in claim 5, wherein the cam groove of the cam member is formed in the bottom board.

8. The ejection mechanism of a card connector as claimed in claim 5, wherein the slider pin of the cam member is engaged with the bottom board.

9. The ejection mechanism of a card connector as claimed in claim 5, wherein the slider has a sliding arm which is shaped with the pressed member, the pressed member is composed of a sliding blade and a sliding aperture, the sliding blade is bent downwardly and vertically from a bottom end of the sliding arm, and the sliding aperture is formed on the sliding blade.

10. The ejection mechanism of a card connector as claimed in claim 9, wherein the guiding wall is formed with a holding hole, the supporting shaft passes through the sliding aperture, the spring and the holding hole in which the supporting shaft is held.

* * * * *